US006382456B1

(12) United States Patent
Onishi et al.

(10) Patent No.: US 6,382,456 B1
(45) Date of Patent: May 7, 2002

(54) SEALING DEVICE FOR A HIGH-PRESSURE VESSEL

(75) Inventors: Yoshihiko Onishi; Shoichiro Nishitani; Kazuhiro Arisue; Hiroyuki Suzuki, all of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/184,017

(22) Filed: Nov. 2, 1998

(30) Foreign Application Priority Data

Mar. 31, 1998 (JP) ..... 10--87052

(51) Int. Cl.[7] ..... F02M 37/04; F17C 1/00

(52) U.S. Cl. ..... 220/581; 220/612; 123/467

(58) Field of Search ..... 123/447, 467, 123/456; 220/359.4, 796, 797, 309.1, 361, 581, 612

(56) References Cited

U.S. PATENT DOCUMENTS

| | | | | | |
|---|---|---|---|---|---|
| 373,763 | A | * | 11/1887 | Ayer | 220/361 |
| 608,349 | A | * | 8/1898 | Sterne | 220/581 |
| 1,090,218 | A | * | 3/1914 | Kruse | 220/612 |
| 1,897,163 | A | * | 2/1933 | Thomas | 220/581 |
| 2,805,789 | A | | 9/1957 | Kreh, Jr. et al. | |
| 2,821,325 | A | * | 1/1958 | Chapeglier | 220/612 |
| 2,857,073 | A | * | 10/1958 | Tinker | 220/612 |
| 3,136,447 | A | * | 6/1964 | Lawrence | 220/612 |
| 3,243,073 | A | * | 3/1966 | Gibson | 220/559.1 |
| 3,458,224 | A | * | 7/1969 | Freese | 220/612 |
| 4,673,814 | A | * | 6/1987 | Schroeder | 220/612 |
| 5,651,940 | A | * | 7/1997 | Buonaiuto | 220/361 |
| 5,673,933 | A | * | 10/1997 | Miller | 220/361 |

FOREIGN PATENT DOCUMENTS

| | | |
|---|---|---|
| DE | 24 57 407 | 6/1976 |
| DE | 201 343 | 7/1983 |
| DE | 44 31 593 | 3/1996 |
| EP | 157 335 | 10/1985 |
| JP | 2-225801 | 9/1990 |

* cited by examiner

*Primary Examiner*—Carl S. Miller
(74) *Attorney, Agent, or Firm*—Sughrue Mion PLLC

(57) ABSTRACT

A highly-reliable, low cost, easily-sealed, sealing device of simple construction is provided for the gas charge inlet of a high-pressure vessel charged with high-pressure gas.

A sealing device for sealing a gas charge inlet 101*a* of a high-pressure vessel 101 having a high-pressure chamber 105 in which high-pressure gas is sealed is provided with a steel ball 102 pressed into a cylindrical hole 101*c* in the gas charge inlet 101*a* to form a seal, and a plug member 103 disposed in the gas charge inlet 101*a* on the low-pressure side of the steel ball 102, sealed by welding to the high-pressure vessel 101. A sealing device combining variously a steel ball 122, 142 inserted into the gas charge inlet 101*a*, and a plug member 113, 123, 133, 143 pressed, welded, or screwed into the gas charge inlet.

8 Claims, 7 Drawing Sheets

SEALING DEVICE FOR A HIGH-PRESSURE VESSEL

BACKGROUND OF THE INVENTION

1. Field of the Invention

This present invention relates to a sealing device for a high-pressure vessel, and especially to a sealing device for a surge absorption device, mainly in a high-pressure fuel pump such as is used in a cylinder-injected engine, capable of reducing surge amplitude and thus enabling stabilization of the amount of fuel injected and stabilization of the engine cycle.

2. Description of the Related Art

Diesel engines are the most widely known of the so-called "cylinder-injected" or "direct injection engines", engines in which fuel is injected into the engine cylinder, but in recent years cylinder-injected spark ignition engines (gasoline engines) have also been proposed. Cylinder-injected engines of this kind demand that fuel pressure surges be minimized to maintain sufficiently high fuel injection pressure and ensure stable injection. To this end, compact single-cylinder high-pressure fuel pumps have been proposed which are of simple construction and inexpensive to manufacture. However, because there is only one plunger in the single-cylinder system, there are surges of quite some amplitude in the pressure of the fuel discharged, and so surge absorption devices with metal bellows or diaphragms have been proposed to absorb these surges.

FIG. 10 shows a high-pressure fuel supply system provided with a high-pressure accumulator which is a good example of a surge absorption device to which the sealing device of the present invention can be applied. In FIG. 10, a delivery pipe 1, which is a fuel injection apparatus, is provided with a plurality of injectors 1*a* corresponding to the number of engine cylinders, which are not shown. A high-pressure fuel pump assembly 200 provided with a high-pressure fuel pump 3 is disposed between the delivery pipe 1 and a fuel tank 2. The delivery pipe 1 and the high-pressure fuel pump 3 are connected by a high-pressure fuel passage 4 and the high-pressure fuel pump 3 and the fuel tank 2 are connected by a low-pressure fuel passage 5. Together, the high-pressure fuel passage 4 and the low-pressure fuel passage 5 compose a fuel passage connecting the delivery pipe 1 to the fuel tank 2. A filter 6 is disposed in the fuel intake of the high-pressure fuel pump 3. A check valve 7 is disposed on the fuel discharge side of the high-pressure fuel pump 3. A drain 8 attached to the high-pressure fuel pump 3 returns to the fuel tank 2.

A low-pressure fuel pump 10 is disposed at the end of the low-pressure fuel passage 5 close to the fuel tank 2. A filter 11 is disposed in the fuel intake of the low-pressure fuel pump 10. A check valve 12 is disposed in the low-pressure fuel passage 5 on the fuel discharge side of the low-pressure fuel pump 10. A low-pressure regulator 14 is disposed in the low-pressure fuel passage 5 between the high-pressure fuel pump 3 and the low-pressure fuel pump 10. A filter 15 is disposed in the fuel intake of the low-pressure regulator 14. A drain 16 attached to the low-pressure regulator 14 returns to the fuel tank 2.

The high-pressure fuel pump 3 increases the pressure of the fuel supplied to it by the low-pressure fuel passage 5 and discharges it to the delivery pipe 1. A dumper 30 is disposed on the low-pressure fuel passage 5 side of the high-pressure fuel pump 3, i.e., the low-pressure side. A high-pressure accumulator 70 and a high-pressure regulator 32 are disposed on the high-pressure side of the high-pressure fuel pump 3. A drain 33 attached to the high-pressure regulator 32 returns to the fuel input side of the high-pressure fuel pump 3.

FIG. 11 is a cross-section showing details of the high-pressure fuel pump assembly 200 when fully assembled, comprising the high-pressure fuel pump 3, dumper 30, high-pressure accumulator 70, high-pressure regulator 32, filter 6, and check valve 7. In FIG. 11, a recess portion 40*c* is formed in the casing 40 on the right-hand side of the diagram, and the high-pressure accumulator 70 is secured to the recess portion 40*c*. A discharge passage 4*b* which communicates with a discharge passage 4*a* is formed as a recess in the bottom of the recess portion 40*c*.

FIG. 12 is a cross-section showing details of the high-pressure accumulator 70, which is a surge absorption device to which the sealing device of the present invention can be applied. The high-pressure accumulator 70 is provided with a case 85, which is a high-pressure vessel roughly the shape of a thick disk, a flexible disk-shaped metal diaphragm 86, supported by and sealed against the case 85 around its perimeter portion so that together they form a high-pressure chamber 71, and a disk-shaped plate 89, which is a stopper defining the limit of deformation of the diaphragm 86.

The case 85 has a comparatively thin perimeter portion 72, which supports and seals the outer perimeter portion of the diaphragm 86 by a sealing weld, and a comparatively thick central portion 73, in which the high-pressure chamber 71 is formed. A male thread 91 is formed on the cylindrical outer surface of the peripheral portion 72, and a comparatively shallow saucer-shaped recess portion 74, which gradually deepens from the perimeter portion towards the central portion in a smooth curve to allow the diaphragm 86 to deform towards the high-pressure chamber 71, is formed in the portion in close contact with the diaphragm 86. An approximately-cylindrical recess portion 75, which communicates with the shallow saucer-shaped recess portion 74 at the central portion, is formed in the central portion 73 and, together with the saucer-shaped recess portion 74, forms the high-pressure chamber 71.

A gas charge inlet 84 of circular cross-section about its central axis is formed in the ceiling portion of the high-pressure chamber 71 to introduce high-pressure gas to the high-pressure chamber 71 of the case 85 and seal it in, and a special thread member 87 is disposed therein as a sealing device to seal the gas charge inlet 84. The gas charge inlet 84 is provided with a small-diameter portion 76 of comparatively small diameter on the high-pressure side facing the high-pressure chamber 71, and a large-diameter portion 77 of comparatively large diameter on the low-pressure side facing the exterior of the case 85. A shoulder portion 78 is formed between the small-diameter portion 76 and the large-diameter portion 77, and a female thread is formed on the inner circumference surface of the small-diameter portion 76. An annular groove 79 is disposed in the shoulder portion 78 to accommodate an O-ring 88.

The special thread member 87 inserted into the gas charge inlet 84 has a large-diameter portion 81, which is inserted into the large-diameter portion 77 of the gas charge inlet 84, and a small-diameter portion 80, which has a thread around its outer cylindrical surface which engages the female thread of the small-diameter portion 76, and the large-diameter portion 81 inserted into the gas charge inlet 84 presses on the O-ring 88 and seals the gas charge inlet 84.

The perimeter portion of the diaphragm 86 is sealed and supported on the outer perimeter portion of the case 85 by a weld portion 82 made by an electron beam or the like. In addition a saucer-shaped plate 89 is disposed on the diaphragm 86 as a stopper to define the limit of deformation of the diaphragm 86, and the plate 89 is also fastened around its circumference by the weld portion 82. A recess portion 83 shaped like one side of a convex lens is formed on the inner face of the plate 89, which gradually deepens from the outer perimeter portion of the diaphragm 86 towards the center, and communicating holes 90 are formed as fuel channels which communicate with the recess portion 83.

The case 85, the metal diaphragm 86, and the plate 89 are all hermetically sealed and bonded to each other around their outer perimeter portions by an electron beam, or the like. The space sealed between the metal diaphragm 86 and the case 85 is charged with a high-pressure gas such as nitrogen.

In the high-pressure fuel pump assembly 200 in FIG. 11, a male thread 91 formed around the outside of the case 85 engages a corresponding female thread formed in the recess portion 40*c*, and the high-pressure accumulator 70 is inserted into the plate 89, sealed by an O-ring 51, and secured to the recess portion 40*c* so as to allow the communicating holes 90 to communicate with the discharge passage 4*b*.

The high-pressure accumulator 70 constructed in this way, absorbs surges in the pressure of the fuel discharged by the discharge passage 4*b*. That is, while fuel is being discharged through the discharge passage 4*b*, surges occur in the discharge passage 4*b*, for example, when the high-pressure fuel pump 3 is operating. The volume of the high-pressure chamber 71 varies in response to changes caused by the surges until the pressure of the high-pressure gas in the high-pressure chamber 71 reaches equilibrium with the pressure in the discharge passage 4*b* through the diaphragm 86. For example, when the pressure in the discharge passage 4*b* rises, the diaphragm 86 is deformed such that the volume of the high-pressure chamber 71 decreases and the volume of the discharge passage 4*b* increases, and so the pressure in the discharge passage 4*b* decreases and surging is reduced.

After charging the device with high-pressure gas such as nitrogen through the gas charge inlet 84, the O-ring 88 is inserted, the special thread member 87, which has a male thread portion, is screwed in, and the space between the case 85 and the special thread member 87 is sealed by the O-ring 88, sealing the high-pressure gas into the high-pressure accumulator 70.

However, the high-pressure accumulator 70 arranged in the manner described above suffers from the following problems:

- because the gas charge inlet 84 is sealed in only one place, deterioration of the O-ring 88 can result in the high-pressure gas leaking from the high-pressure accumulator 70, leading to a decline in its ability to absorb surges;
- sealing high-pressure gas into the high-pressure accumulator 70 is not easy and requires special equipment to work at atmospheric pressure;
- because O-rings 88 are used, manufacturing costs are high; and
- the gas charge inlet 84 must be a prescribed thickness to ensure enough thread to withstand the high pressure, but because it is disposed in the center of the high-pressure accumulator 70, it makes the case 85 thicker and therefore the size of the case 85 cannot be reduced.

SUMMARY OF THE INVENTION

Consequently, an object of the present invention is to provide a highly-reliable sealing device of simple construction for the gas charge inlet of a high-pressure vessel to overcome the above problems.

The sealing device according to the present invention is provided with a mechanical seal portion disposed in a gas charge inlet, and a welded seal portion disposed in the gas charge inlet on the low-pressure side of the mechanical seal portion.

Also, the sealing device according to the present invention is characterized in that the mechanical seal portion may be a steel ball pressed into the gas charge inlet to form a seal, and the welded seal portion may be a plug member disposed in the gas charge inlet on the low-pressure side of the steel ball and sealed by welding to the high-pressure vessel.

Also, the sealing device according to the present invention is characterized in that the mechanical seal portion and the welded seal portion may be formed in one member.

Also, the sealing device according to the present invention is characterized in that the one member may be a plug member provided with a press-fit portion pressed into the gas charge inlet and a welded seal portion disposed in the gas charge inlet on the low-pressure side of the press-fit portion and sealed by welding to the high-pressure vessel.

Also, the sealing device according to the present invention is characterized in that the one member may be a hollow plug member disposed in the gas charge inlet having a closed end on the high-pressure side and an open end on the low-pressure side, and in that it may be provided with a steel ball which is pressed inside the plug member to press the plug member against the inside of the gas charge inlet and form a seal.

Also, the sealing device according to the present invention may be provided with a plug member which has a tapered surface with its narrow end towards the high-pressure side, the tapered surface being ring-projection welded around its circumference to the gas charge inlet of the high-pressure vessel.

Also, the sealing device according to the present invention may be provided with a small-diameter portion disposed in the gas charge inlet, a female thread disposed on the low-pressure side of the small-diameter portion, a steel ball in contact with the small-diameter portion, and a plug member which engages the female thread in the gas charge inlet, and presses the steel ball against the small-diameter portion to form a seal.

Also, the sealing device according to the present invention is characterized in that the plug member may be provided with a weld portion around its circumference on the low-pressure side.

Also, the sealing device according to the present invention is characterized in that the gas charge inlet may be disposed on a perimeter portion of the high-pressure vessel.

Also, the sealing device according to the present invention is characterized in that the high-pressure vessel may be mounted on a high-pressure fuel pump assembly used in a cylinder-injected engine.

DETAILED DESCRIPTION OF THE PREFERRED EMBODIMENTS

Embodiment 1

Figure 1:
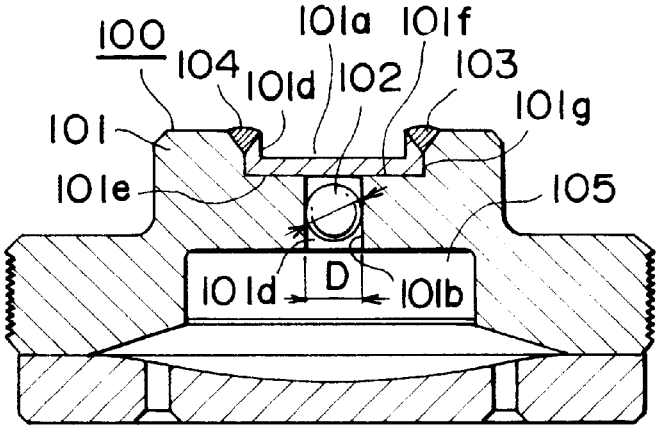
FIG. 1 is a cross-section of the sealing device according to Embodiment 1 of the present invention.
Figure 10:
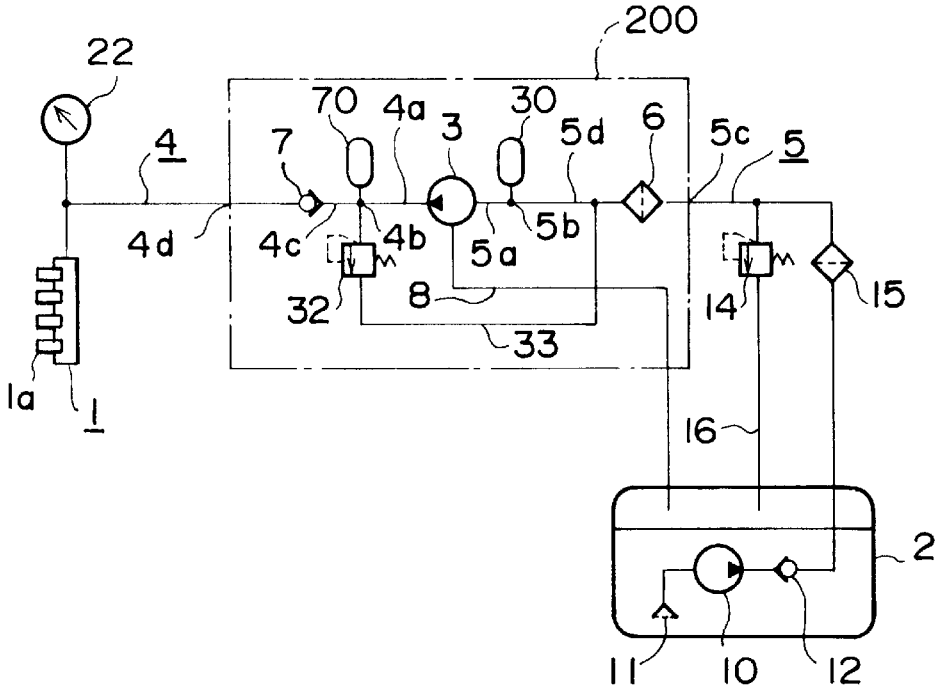
FIG. 10 is a system diagram of a high-pressure fuel supply system provided with a high-pressure accumulator which is a surge absorption device to which the seal construction of the present invention can be applied.
Figure 11:
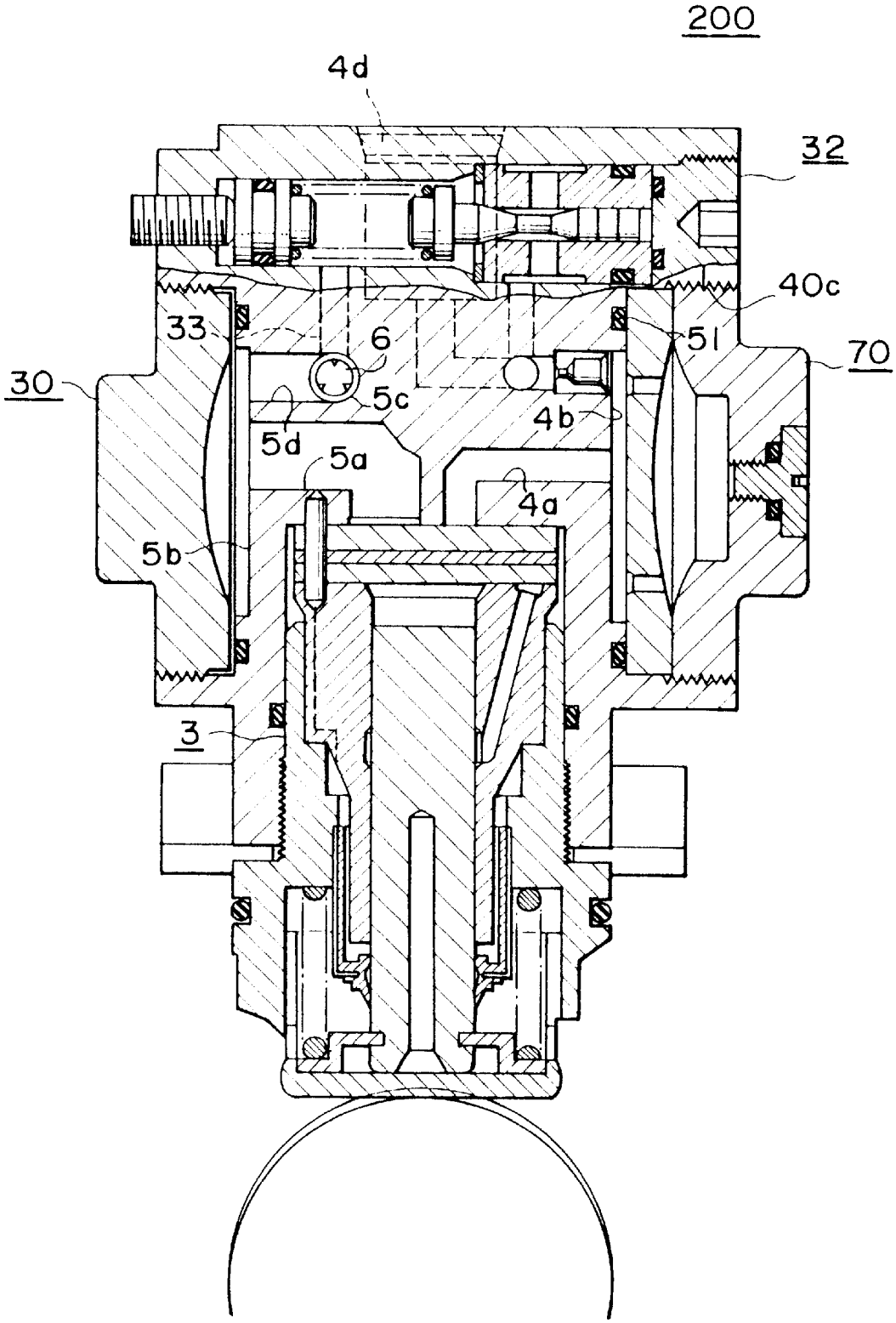
FIG. 11 is a cross-section of a high-pressure fuel pump assembly including a high-pressure accumulator which is a surge absorbtion device to which the seal construction of the present invention can be applied.

FIG. 1 shows an embodiment using the sealing device of the present invention in an accumulator 100. Apart from the seal construction in the gas charge inlet 101*a*, the rest of the construction is the same as in FIG. 10 and further explanation thereof will be omitted.

In the diagram, the gas charge inlet 101*a* of the case 101 has a cylindrical hole 101*c* and a circular recess portion 101*d* of larger diameter than the cylindrical hole 101*c*, which forms a shoulder portion 101*e*. The cylindrical hole 101*c* has a diameter D which is smaller than the diameter d of the steel ball 102, and has an inner circumference surface 101*b* into which the steel ball 102 is pressed. Also, the circular recess portion 101*d* is a recess for mounting a plug member 103 on the shoulder portion 101*e* on the opposite side of the steel ball 102 from the high-pressure side which forms the high-pressure chamber 105 in which high-pressure gas is sealed. The plug member 103 is roughly the shape of a shallow cup and has a circular base wall 101*f* which closes the circular recess portion 101*d* and a cylindrical wall 101*g* which rises from the circular base wall 101*f*. The case 101 and the cylindrical wall 101*g* are welded around their circumferences at the entrance to the gas charge inlet 101*a*, forming an air-tight weld portion 104 between the case 101 and the plug member 103. Consequently, a mechanical seal is formed between the steel ball 102 and the inner circumference surface 101*b*, and the weld portion 104 is a welded seal portion.

Figure 9:
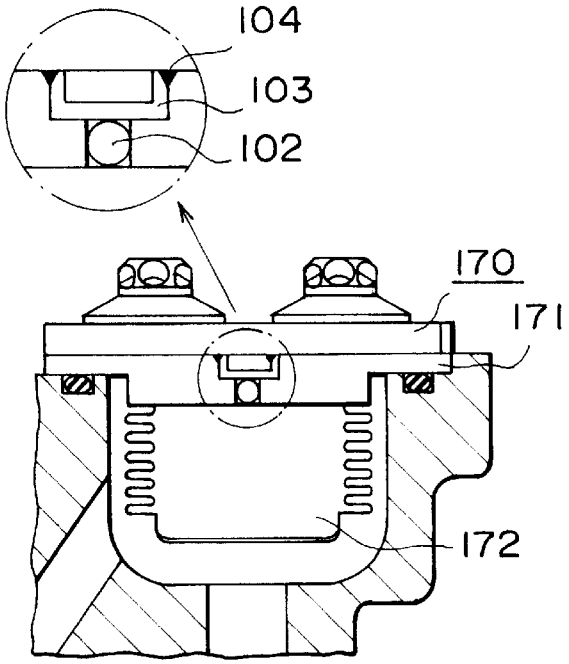
FIG. 9 is a cross-section of a variation of the sealing device according to Embodiment 1 of the present invention.
Figure 12:
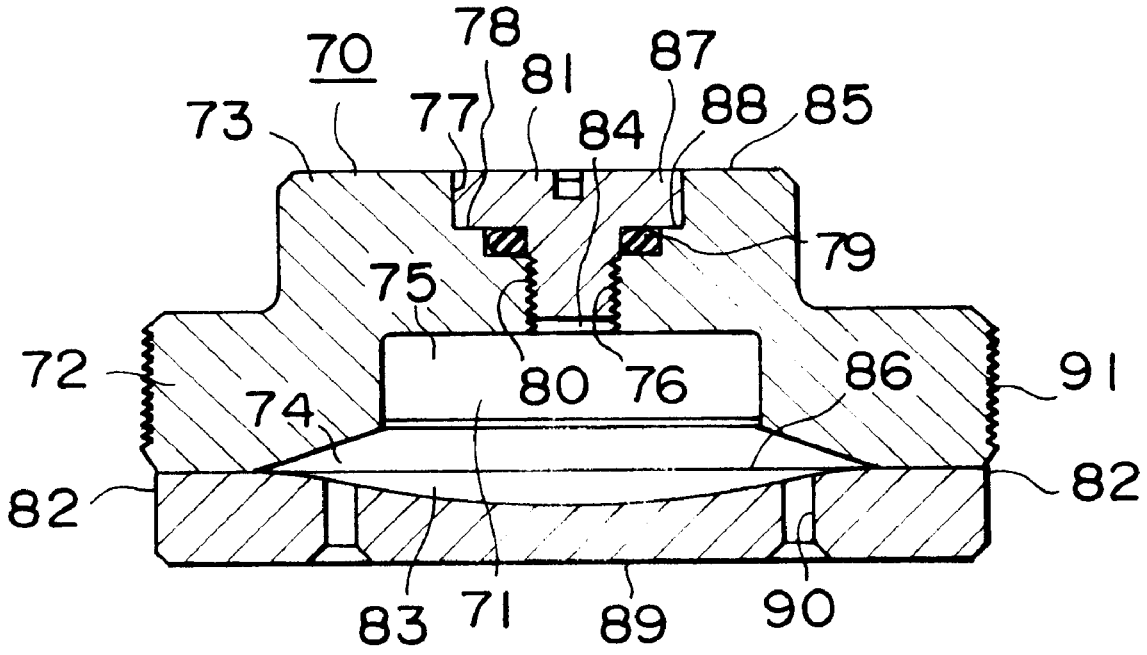
FIG. 12 is a cross-section of a high-pressure accumulator which is a surge absorption device to which the seal construction of the present invention can be applied.

FIG. 9 shows a variation in which a sealing device which is an embodiment of the present invention is used in a metal bellows-type accumulator 170. The diagram shows an accumulator employing a bellows to fulfil the role of the diaphragm in FIG. 12, and as shown in FIG. 1, a steel ball is inserted into a gas charge inlet, and a plug member disposed on the low-pressure side of the steel ball 102 is sealed and welded to a case 171 by means of a weld portion 104.

Embodiment 2

Figure 2:
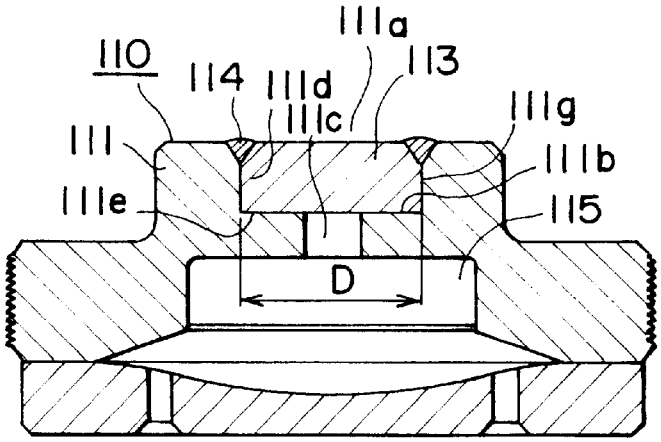
FIG. 2 is a cross-section of the sealing device according to Embodiment 2 of the present invention.

FIG. 2 shows a different embodiment using the sealing device of the present invention in an accumulator 110. Apart from the seal construction in the gas charge inlet 111*a*, the rest of the construction is the same as in FIG. 10 and further explanation thereof will be omitted.

In the diagram, the gas charge inlet 111*a* of the case 111 has a cylindrical hole 111*c* and a circular recess portion 111*d* of larger diameter than the cylindrical hole 111*c*, which forms a shoulder portion 111*e*. The circular recess portion 111*d* is a recess for mounting a plug member 113 on the shoulder portion 111*e* on the opposite side of the cylindrical hole 111*c* from the high-pressure side which forms the high-pressure chamber 115 in which high-pressure gas is sealed. Also, the circular recess portion 111*d* has a smaller diameter D than the diameter d of the outer surface of the pressed-in plug member 113, and has an inner circumference surface 111*b* into which the plug member 113 is pressed. The plug member 113 is a roughly disk-shaped having a cylindrical wall 111*g*, and the case 111 and the cylindrical wall 111*g* are welded around their circumferences at the entrance to the gas charge inlet 111*a*, forming an air-tight weld portion 114 between the case 111 and the plug member 113.

Consequently, a mechanical seal is formed between the plug member 113 and the inner circumference surface 111*b*, and the weld portion 114 is a welded seal portion.

Embodiment 3

Figure 3:
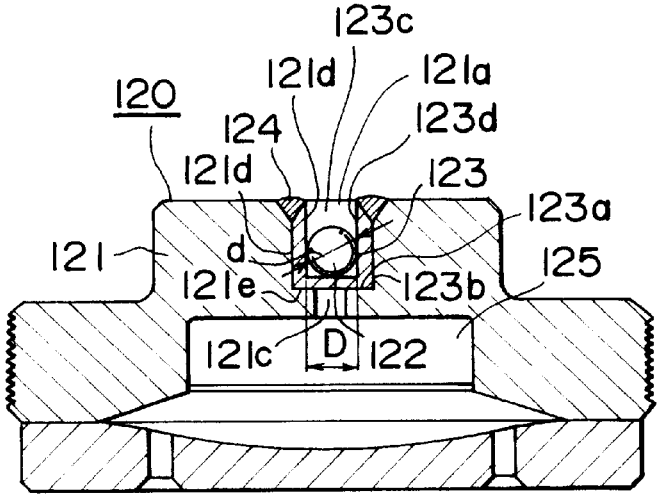
FIG. 3 is a cross-section of the sealing device according to Embodiment 3 of the present invention.

FIG. 3 shows a different embodiment using the sealing device of the present invention in an accumulator 120. Apart from the seal construction in the gas charge inlet 121*a*, the rest of the construction is the same as in FIG. 10 and further explanation thereof will be omitted.

In the diagram, the gas charge inlet 121*a* of the case 121 has a cylindrical hole 121*c* and a circular recess portion 121*d* of larger diameter than the cylindrical hole 121*c*, which forms a shoulder portion 121*e*. The circular recess portion 121*d* is a recess for mounting a plug member 123 on the shoulder portion 121*e* on the opposite side of the cylindrical hole 121*c* from the high-pressure side which forms the high-pressure chamber 125 in which high-pressure gas is sealed. The plug member 123 is roughly the shape of a deep cup with the closed end on the high-pressure side and the open end on the low-pressure side, and is provided with a circular base wall 123*a* which closes the circular recess portion 121*d* and a cylindrical wall 123*b* which rises from the circular base wall 123*a*, and is also provided with a cylindrical hole 123*c* on the inside of the cylindrical wall 123*b*. The cylindrical hole 123*c* has a diameter D which is smaller than the diameter d of the steel ball 122, and has an inner circumference surface 123*b* into which the steel ball 122 is pressed. The steel ball 122 is pressed into the inner circumference surface 123*d* and the plug member 123 is pressed against the inner circumference surface 121*b* of the gas charge inlet 121*a* to form a seal. The case 121 and the cylindrical wall 123*b* are welded around their circumferences at the entrance to the gas charge inlet 121*a*, forming an air-tight weld portion 124 between the case 121 and the plug member 123. Consequently, a mechanical seal is formed between the plug member 123 and the inner circumference surface 121*b*, and the weld portion 124 is a welded seal portion.

Embodiment 4

Figure 4:
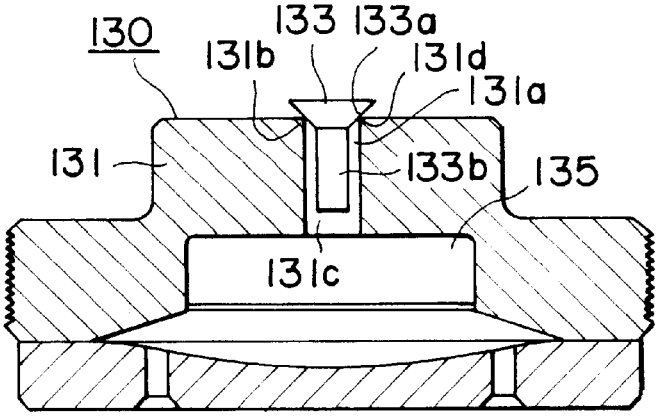
FIG. 4 is a cross-section of the sealing device according to Embodiment 4 of the present invention.

FIG. 4 shows a different embodiment using the sealing device of the present invention in an accumulator 130. Apart from the seal construction in the gas charge inlet 131*a*, the rest of the construction is the same as in FIG. 10 and further explanation thereof will be omitted.

In the diagram, the gas charge inlet 131*a* of the case 131 has a cylindrical hole 131*c*. The plug member 133 is provided with a tapered surface 133*a* with its narrow end towards the high-pressure side which forms the high-pressure chamber 135 in which high-pressure gas is sealed, and a cylinder portion 131*b* which functions as a guide for inserting the plug member 133 into the cylindrical hole 131*c*. The case 131 and the tapered surface 131*a* are ring-projection welded around their circumferences at the entrance to the gas charge inlet 131*a*, forming a seal between the case 131 and the plug member 133. Ring-projection welding forms a metallic bond between the case 131 and the plug member 133 with the tapered surface 131*a* pressed against the sharp edge 131*b* of the cylindrical hole 131*c* of the case 131 by melting the circumference of the contact portion 131*d* using the large amount of heat generated in the narrow current path of the contact portion 131*d* when an electric current is passed between the case 131 and the plug member 133.

Figure 8:
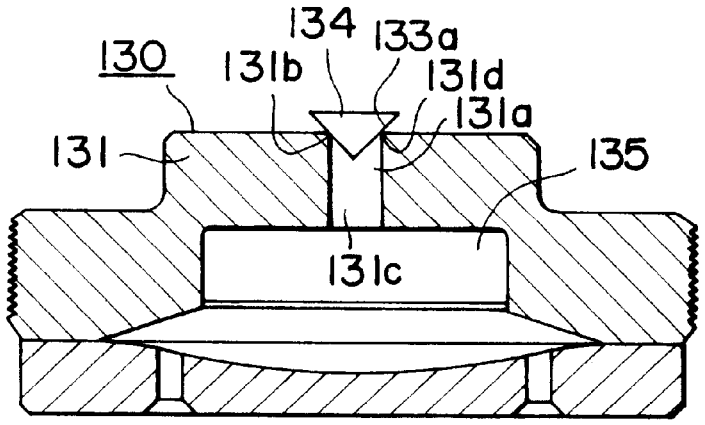
FIG. 8 is a cross-section of a variation of the sealing device according to Embodiment 4 of the present invention.

FIG. 8 shows a variation of the sealing device of Embodiment 4 of the present invention. In the diagram, the shape of the ring-projection welded plug member 134 is different from the shape of the plug member 133 of Embodiment 4 shown in FIG. 4. Unlike plug member 133 which has a cylindrical portion 133*b*, plug member 134 has no cylindrical portion, enabling the height of the accumulator to be reduced.

Embodiment 5

Figure 5:
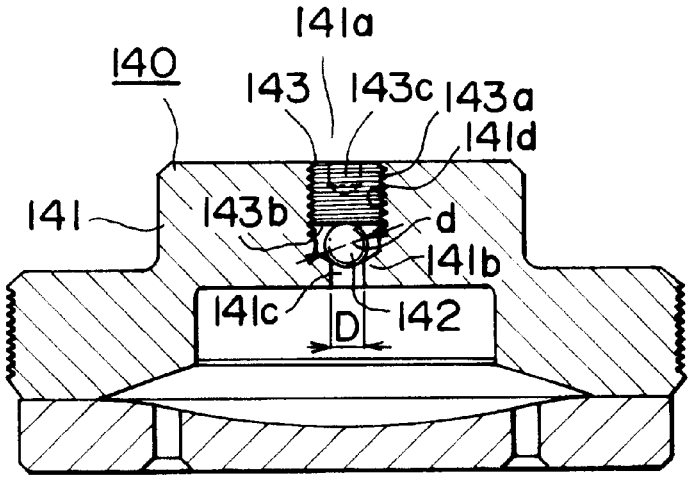
FIG. 5 is a cross-section of the sealing device according to Embodiment 5 of the present invention.

FIG. 5 shows an embodiment using the sealing device of the present invention in an accumulator 140. Apart from the seal construction in the gas charge inlet 141*a*, the rest of the construction is the same as in FIG. 10 and further explanation thereof will be omitted.

In the diagram, the gas charge inlet 141*a* of the case 141 is provided with a cylindrical hole 141*c*, a small-diameter portion in the form of a tapered surface 141*b* whose diameter gradually increases from the low-pressure end of the cylindrical hole 141*c*, and a female thread portion 141*d* of larger diameter than the cylindrical hole 141*c*. The cylindrical hole 141*c* is provided with a diameter D which is smaller than the diameter d of a steel ball 142. A plug member 143 is roughly cylindrical, is provided with a male thread portion 143*a* around the outside, an end portion 143*b* which presses against the steel ball 142, and a hexagonal hole 143*c* at the other end to accommodate an Allen screw (Allen key), and engages the female thread portion 141*d* of the case 141. The steel ball 142 receives the axial force generated in the plug member 143 by engagement of the thread through the end portion 143*b* of the plug member 143 and is pressed against the boundary edge between the cylindrical hole 141*c* and the tapered surface 141*b* or against the tapered surface 141*b*, forming a seal.

Embodiment 6

Figure 6:
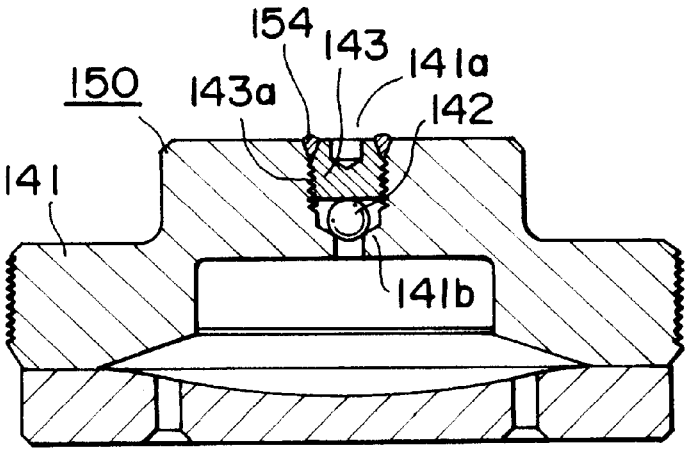
FIG. 6 is a cross-section of the sealing device according to Embodiment 6 of the present invention.

FIG. 6 shows an embodiment using the sealing device of the present invention in an accumulator 150. Apart from the seal construction in the gas charge inlet 141*a*, the rest of the construction is the same as in FIG. 10 and further explanation thereof will be omitted.

Also, in Embodiment 6 a weld portion 154 is added to Embodiment 5, and so points of explanation which duplicate those of Embodiment 5 will be omitted.

In the diagram, in addition to the first seal made by the steel ball 142, the case 141 and the plug member 143 are welded around their circumferences at the entrance to the gas charge inlet 141*a*, forming an air-tight weld portion 154 between the case 141 and the plug member 143, making a second seal.

Embodiment 7

Figure 7:
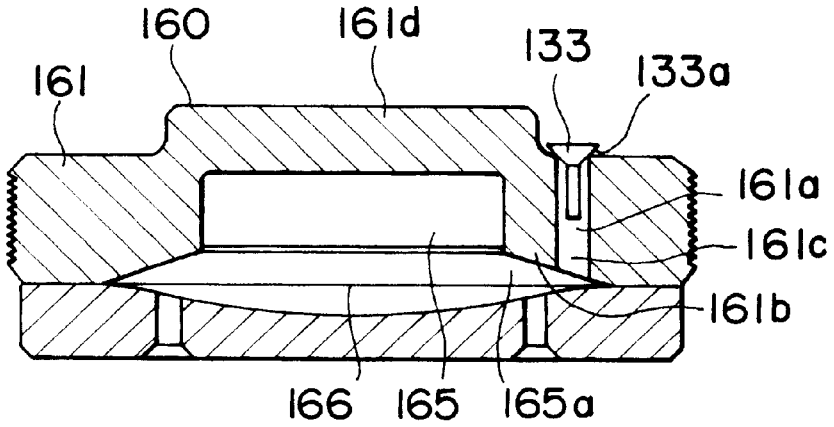
FIG. 7 is a cross-section of the sealing device according to Embodiment 7 of the present invention.

FIG. 7 shows an embodiment using the sealing device of the present invention in an accumulator 160. In this embodiment of the present invention, the position of the gas charge inlet 161*a* has been changed in comparison to Embodiment 4 and so only the differences will be explained.

In the diagram, a high-pressure chamber 165 is formed by a case 161 and a disk-shaped metal diaphragm 166 and is provided with a shallowly-scooped perimeter portion 165*a*. There is a cylindrical hole 161*c* on the perimeter portion 161*b* of the case 161 which communicates with the perimeter portion 165*a* of the high-pressure chamber 165, forming a gas charge inlet 161*a*. Also, there is no gas charge inlet in the central portion 161*d* of the case 161, and so it is thin compared to the central portion 73 of the case in FIG. 10.

Furthermore, as in Embodiment 4, the case 161 and the tapered surface 133*a* are ring-projection welded around their circumferences at the entrance to the gas charge inlet 161*a*, forming a seal between the case 161 and the plug member 133.

Also, any of the above embodiments of seal construction may be used to seal the gas charge inlet 161*a* formed on the perimeter portion.

In accordance with Embodiment 1 in FIG. 1, in a seal construction for the gas charge inlet of a high-pressure vessel having a high-pressure chamber filled with high-pressure gas, there is provided a steel ball pressed into the gas charge inlet to form a seal, and a plug member disposed in the gas charge inlet on the low-pressure side of the steel ball and sealed by welding to the high-pressure vessel. For that reason, the gas charge inlet is sealed by the insertion of the steel ball, making a first seal on the high-pressure chamber filled with high-pressure gas, and then a second seal is made by means of a welded seal portion formed at normal atmospheric pressure, and so the welding operation for the second seal can be performed at normal atmospheric pressure, making the special equipment needed for welding under high pressure unnecessary. Also, the double seal construction improves reliability. In addition, because rubber materials such as O-rings are not used, the seals do not deteriorate with time. Because O-rings and special threads are not used, the construction is cheap.

In accordance with Embodiment 2 in FIG. 2, in a seal construction for the gas charge inlet of a high-pressure vessel having a high-pressure chamber filled with high-pressure gas, there is provided a plug member having a press-fit portion pressed into the gas charge inlet and a welded seal portion disposed in the gas charge inlet on the low-pressure side of the press-fit portion and sealed by welding to the high-pressure vessel. For that reason, the gas charge inlet is sealed by the insertion of the plug member, making a first seal on the high-pressure chamber filled with high-pressure gas, and then a second seal is made by means of a welded seal portion formed at normal atmospheric pressure, and so the welding operation for the second seal can be performed at normal atmospheric pressure, making the special equipment needed for welding under high pressure unnecessary. Also, the double seal construction improves reliability. In addition, because rubber materials such as O-rings are not used, the seals do not deteriorate with time. Because O-rings and special threads are not used, the construction is cheap.

In accordance with Embodiment 3 in FIG. 3, in a seal construction for the gas charge inlet of a high-pressure vessel having a high-pressure chamber filled with high-pressure gas, there is provided a hollow plug member disposed in the gas charge inlet having a closed end on the high-pressure side and an open end on the low-pressure side, and a steel ball which is pressed inside the plug member to press the plug member against the inside of the gas charge inlet and form a seal. For that reason, the plug member is pressed and sealed against the inside of the gas charge inlet by the steel ball which is pressed inside the plug member, making a first seal on the high-pressure chamber filled with high-pressure gas, and then a second seal is made by means of a welded seal portion formed at normal atmospheric pressure, and so the welding operation for the second seal can be performed at normal atmospheric pressure, making the special equipment needed for welding under high pressure unnecessary. Also, the double seal construction improves reliability. In addition, because rubber materials such as O-rings are not used, the seals do not deteriorate with time. Because O-rings and special threads are not used, the construction is cheap.

In accordance with Embodiment 4 in FIG. 4, in a seal construction for the gas charge inlet of a high-pressure vessel having a high-pressure chamber filled with high-pressure gas, there is provided a plug member which has a tapered surface with its narrow end towards the high-pressure side, the tapered surface being ring-projection welded around its circumference to the gas charge inlet of the high-pressure vessel. Thus, because rubber materials such as O-rings are not used, the seals do not deteriorate with time. Because O-rings and special threads are not used, the construction is cheap. Also, because the weld portion is pressed during projection welding, the welding operation can be performed at the same time as the high-pressure gas charging process, shortening the manufacturing process.

In accordance with Embodiment 5 in FIG. 5, in a seal construction for the gas charge inlet of a high-pressure vessel having a high-pressure chamber filled with high-pressure gas, there is provided a small-diameter portion disposed in the gas charge inlet, a female thread disposed on the low-pressure side of the small-diameter portion, a steel ball in contact with the small-diameter portion, and a plug member which engages the female thread in the gas charge inlet, and presses the steel ball against the small-diameter portion to form a seal. Thus, because rubber materials such as O-rings are not used, the seal does not deteriorate with time. Because O-rings and special threads are not used, the construction is cheap.

In accordance with Embodiment 6 in FIG. 6, in the construction of Embodiment 5, there is provided a weld portion around the circumference of the plug member on the low-pressure side. For that reason, the gas charge inlet is sealed by the engagement of the thread, making a first seal on the high-pressure chamber filled with high-pressure gas, and then a second seal is made by means of a welded seal portion formed at normal atmospheric pressure, and so the welding operation for the second seal can be performed at normal atmospheric pressure, making the special equipment needed for welding under high pressure unnecessary. Also, the double seal construction improves reliability. In addition, because rubber materials such as O-rings are not used, the seals do not deteriorate with time. Because O-rings and special threads are not used, the construction is cheap.

In accordance with Embodiment 7 in FIG. 7, a high-pressure chamber is formed by a high-pressure vessel and a disk-shaped metal diaphragm, and the gas charge inlet is disposed in a shallowly-scooped perimeter portion of the high-pressure vessel. For that reason, there is no gas charge inlet in the central portion of the high-pressure vessel, and so the thickness of the high-pressure vessel can be reduced, making it more compact and lighter.

In accordance with the present invention, in a seal construction for the gas charge inlet of a high-pressure vessel having a high-pressure chamber filled with high-pressure gas, there is provided a mechanical seal portion disposed in the gas charge inlet to form a seal, and a welded seal portion disposed in the gas charge inlet on the low-pressure side of the mechanical seal portion. For that reason, the gas charge inlet is sealed by the mechanical seal portion, making a first seal on the high-pressure chamber filled with high-pressure gas, and then a second seal is made by means of a welded seal portion formed at normal atmospheric pressure, and so the welding operation for the second seal can be performed at normal atmospheric pressure, making the special equipment needed for welding under high pressure unnecessary. Also, the double seal construction improves reliability. In addition, because rubber materials such as O-rings are not used, the seals do not deteriorate with time. Because O-rings and special threads are not used, the construction is cheap.

Also in accordance with the present invention, there is provided a steel ball pressed into a gas charge inlet to form a seal, and a plug member disposed in the gas charge inlet on the low-pressure side of the steel ball, sealed by welding to a high-pressure vessel. For that reason, the gas charge inlet is sealed by the insertion of the steel ball, making a first seal on the high-pressure chamber filled with high-pressure gas, and then a second seal is made by means of a weld portion at normal atmospheric pressure, and so the welding operation for the second seal can be performed at normal atmospheric pressure, making the special equipment needed for welding under high pressure unnecessary. Also, the double seal construction improves reliability. In addition, because rubber materials such as O-rings are not used, the seals do not deteriorate with time. Because O-rings and special threads are not used, the construction is cheap.

Also in accordance with the present invention, a mechanical seal portion and a welded seal portion are formed in one member. For that reason, the gas charge inlet is sealed by the mechanical seal portion, making a first seal on the high-pressure chamber filled with high-pressure gas, and then a second seal is made by means of a welded seal portion formed at normal atmospheric pressure, and so the welding operation for the second seal can be performed at normal atmospheric pressure, making the special equipment needed for welding under high pressure unnecessary. Also, the double seal construction improves reliability. In addition, because rubber materials such as O-rings are not used, the seals do not deteriorate with time. Because O-rings and special threads are not used, the construction is cheap.

Also in accordance with the present invention, in a seal construction for the gas charge inlet of a high-pressure vessel having a high-pressure chamber filled with high-pressure gas, there is provided a plug member having a press-fit portion pressed into the gas charge inlet and a welded seal portion disposed in the gas charge inlet on the low-pressure side of the press-fit portion and sealed by welding to the high-pressure vessel. For that reason, the gas charge inlet is sealed by the insertion of the plug member, making a first seal on the high-pressure chamber filled with high-pressure gas, and then a second seal is made by means of a weld portion at normal atmospheric pressure, and so the welding operation for the second seal can be performed at normal atmospheric pressure, making the special equipment needed for welding under high pressure unnecessary. Also, the double seal construction improves reliability. In addition, because rubber materials such as O-rings are not used, the seals do not deteriorate with time. Because O-rings and special threads are not used, the construction is cheap.

Also in accordance with the present invention, in a seal construction for the gas charge inlet of a high-pressure vessel having a high-pressure chamber filled with high-pressure gas, there is provided a hollow plug member disposed in the gas charge inlet having a closed end on the high-pressure side and an open end on the low-pressure side, and a steel ball which is pressed inside the plug member to press the plug member against the inside of the gas charge inlet and form a seal. For that reason, the plug member is pressed and sealed against the inside of the gas charge inlet by the steel ball which is pressed inside the plug member, making a first seal on the high-pressure chamber filled with high-pressure gas, and then a second seal is made by means of a weld portion at normal atmospheric pressure, and so the welding operation for the second seal can be performed at normal atmospheric pressure, making the special equipment needed for welding under high pressure unnecessary. Also, the double seal construction improves reliability. In addition, because rubber materials such as O-rings are not used, the seals do not deteriorate with time. Because O-rings and special threads are not used, the construction is cheap.

Also in accordance with the present invention, in a seal construction for the gas charge inlet of a high-pressure vessel having a high-pressure chamber filled with high-pressure gas, there is provided a plug member which has a tapered surface with its narrow end towards the high-pressure side, the tapered surface being ring-projection welded around its circumference to the gas charge inlet of the high-pressure vessel. Thus, because rubber materials such as O-rings are not used, the seal does not deteriorate with time. Because O-rings and special threads are not used, the construction is cheap. Also, because the weld portion is pressed during projection welding, the welding operation can be performed at the same time as the high-pressure gas charging process, shortening the manufacturing process.

Also in accordance with the present invention, in a seal construction for the gas charge inlet of a high-pressure vessel having a high-pressure chamber filled with high-pressure gas, there is provided a small-diameter portion disposed in the gas charge inlet, a female thread disposed on the low-pressure side of the small-diameter portion, a steel ball in contact with the small-diameter portion, and a plug member which engages the female thread in the gas charge inlet, and presses the steel ball against the small-diameter portion to form a seal. Thus, because rubber materials such as O-rings are not used, the seal does not deteriorate with time. Because O-rings and special threads are not used, the construction is cheap.

Also in accordance with the present invention, there is provided a weld portion around circumference of a plug member on the low-pressure side. For that reason, the gas charge inlet is sealed by the engagement of the thread, making a first seal on the high-pressure chamber filled with high-pressure gas, and then a second seal is made by means of a weld portion at normal atmospheric pressure, and so the welding operation for the second seal can be performed at normal atmospheric pressure, making the special equipment needed for welding under high pressure unnecessary. Also, the double seal construction improves reliability. In addition, because rubber materials such as O-rings are not used, the seals do not deteriorate with time. Because O-rings and special threads are not used, the construction is cheap.

Also in accordance with the present invention, a high-pressure chamber is formed by a high-pressure vessel and a disk-shaped metal diaphragm, and the gas charge inlet is disposed in a shallowly-scooped perimeter portion of the high-pressure vessel. For that reason, there is no gas charge inlet in the central portion of the high-pressure vessel, and so the height of the high-pressure vessel can be reduced, making it more compact and lighter.

Also in accordance with the present invention, the high-pressure vessel is mounted on a high-pressure fuel pump assembly used in a cylinder-injected engine. For that reason, a highly-reliable, low cost, light, compact high-pressure fuel pump can be provided.

What is claimed is:

1. A sealing device for a gas charge inlet of a high-pressure vessel having a high-pressure chamber filled with high-pressure gas comprising:

a mechanical seal portion disposed in said gas charge inlet; and a welded seal portion disposed in said gas charge inlet on the low-pressure side of said mechanical seal portion, wherein said mechanical seal portion and said welded seal portion are formed in one member.

2. The sealing device according to claim 1 characterized in that said gas charge inlet is disposed on a perimeter portion of said high-pressure vessel.

3. The sealing device according to claim 1 characterized in that said high-pressure vessel is mounted on a high-pressure fuel pump assembly used in a cylinder-injected engine.

4. The sealing device according to claim 1 characterized in that said one member is a plug member provided with a press-fit portion pressed into said gas charge inlet and a welded seal portion disposed in said gas charge inlet on the low-pressure side of said press-fit portion and sealed by welding to said high-pressure vessel.

5. The sealing device according to claim 4 characterized in that said high-pressure vessel is mounted on a high-pressure fuel pump assembly used in a cylinder-injected engine.

6. The sealing device according to claim 1 characterized in that said one member is a hollow plug member disposed in said gas charge inlet having a closed end on the high-pressure side and an open end on the low-pressure side, and in that it is provided with a steel ball which is pressed inside said plug member to press said plug member against the inside of said gas charge inlet and form a seal.

7. The sealing device according to claim 6 characterized in that said gas charge inlet is disposed on a perimeter portion of said high-pressure vessel.

8. The sealing device according to claim 6 characterized in that said high-pressure vessel is mounted on a high-pressure fuel pump assembly used in a cylinder injected engine.

* * * * *